US012460832B2

(12) United States Patent
Bhardwaj et al.

(10) Patent No.: US 12,460,832 B2
(45) Date of Patent: Nov. 4, 2025

(54) REFRIGERANT DETECTION FOR A COOLING SYSTEM

(71) Applicant: Lennox Industries Inc., Richardson, TX (US)

(72) Inventors: Vickey Bhardwaj, Chennai (IN); Siddarth Rajan, Addison, TX (US); Rakesh Goel, Irving, TX (US)

(73) Assignee: Lennox Industries Inc., Richardson, TX (US)

( * ) Notice: Subject to any disclaimer, the term of this patent is extended or adjusted under 35 U.S.C. 154(b) by 217 days.

(21) Appl. No.: 18/156,112

(22) Filed: Jan. 18, 2023

(65) Prior Publication Data

US 2024/0240819 A1 Jul. 18, 2024

(51) Int. Cl.

| | |
|---|---|
| ***F24F 11/36*** | (2018.01) |
| ***F24F 11/64*** | (2018.01) |
| ***F24F 11/77*** | (2018.01) |
| ***F24F 11/86*** | (2018.01) |
| ***F24F 11/89*** | (2018.01) |

(52) U.S. Cl.

CPC ..... *F24F 11/36* (2018.01); *F24F 11/64* (2018.01); *F24F 11/77* (2018.01); *F24F 11/86* (2018.01); *F24F 11/89* (2018.01)

(58) Field of Classification Search

CPC .. F24F 11/77; F24F 11/36; F24F 11/86; F24F 11/64; F24F 11/89

See application file for complete search history.

(56) References Cited

U.S. PATENT DOCUMENTS

| | | | | |
|---|---|---|---|---|
| 6,030,437 | A * | 2/2000 | Gourrier | F24F 8/10 96/417 |
| 11,125,457 | B1 * | 9/2021 | Alfano | F24F 11/36 |
| 11,435,101 | B2 | 9/2022 | Branson et al. | |
| 11,441,813 | B2 * | 9/2022 | Tsuji | F25B 49/005 |
| 11,859,837 | B2 | 1/2024 | Sadanandan et al. | |
| 11,971,184 | B2 | 4/2024 | Branson et al. | |
| 2002/0178738 | A1 * | 12/2002 | Taira | F24F 11/30 62/181 |
| 2017/0198936 | A1 * | 7/2017 | Yamaguchi | F24F 11/74 |
| 2018/0313591 | A1 * | 11/2018 | Obara | F24F 13/20 |
| 2021/0213802 | A1 * | 7/2021 | Poolman | B60H 1/3232 |
| 2021/0278128 | A1 * | 9/2021 | Scarcella | F25D 29/006 |
| 2021/0293446 | A1 * | 9/2021 | Fard | F24F 13/20 |

(Continued)

*Primary Examiner* — Nelson J Nieves
(74) *Attorney, Agent, or Firm* — Baker Botts L.L.P.

(57) ABSTRACT

A controller is configured to operate a heating, ventilation, and air conditioning (HVAC) system based on a plurality of concentration measurements received from a refrigerant detection sensor. The controller is configured to receive the plurality of concentration measurements from the refrigerant detection sensor disposed upstream of an evaporator coil. The controller is further configured to determine if a concentration of a refrigerant in a volume exceeds a stored threshold value based at least in part on the received plurality of concentration measurements. In response to determining that the concentration of refrigerant in the volume does exceed the stored threshold value, the controller is configured to operate the HVAC system in a second mode of operation, wherein the second mode of operation includes turning off a compressor and actuating a blower disposed downstream of the evaporator coil to discharge an airflow.

19 Claims, 6 Drawing Sheets

(56) References Cited

U.S. PATENT DOCUMENTS

| | | | | |
|---|---|---|---|---|
| 2021/0302056 | A1* | 9/2021 | Eskew | G01M 1/122 |
| 2021/0396412 | A1* | 12/2021 | Watanabe | F25B 41/24 |
| 2022/0307740 | A1* | 9/2022 | Lord | F25B 49/005 |
| 2023/0094980 | A1* | 3/2023 | Birnkrant | B60H 1/00978 62/503 |
| 2023/0097844 | A1* | 3/2023 | Birnkrant | G01N 21/255 62/126 |
| 2023/0221024 | A1* | 7/2023 | Steen | F24F 3/065 62/160 |
| 2024/0068685 | A1 | 2/2024 | Lowrimore et al. | |
| 2024/0200843 | A1* | 6/2024 | Wada | F25B 41/20 |
| 2024/0219064 | A1* | 7/2024 | Asanuma | F24F 11/36 |
| 2024/0230129 | A1 | 7/2024 | Branson et al. | |

* cited by examiner

REFRIGERANT DETECTION FOR A COOLING SYSTEM

TECHNICAL FIELD

The present disclosure relates generally to heating, ventilation, and air conditioning (HVAC) system control, and more specifically to refrigerant detection for a cooling system.

BACKGROUND

Heating, ventilation, and air conditioning (HVAC) systems are used to regulate environmental conditions within an enclosed space. Air is cooled or heated via heat transfer with refrigerant flowing through the system and returned to the enclosed space as conditioned air. During operation, refrigerant may leak from the working-fluid conduit subsystem or from one or more components.

SUMMARY

Regulations in the HVAC industry are pushing manufacturers to transition away from traditional refrigerants towards low global warming potential (GWP) refrigerants, particularly mildly flammable (A2L) refrigerants and flammable (A3) refrigerants. Currently, there is a need to develop HVAC systems that are optimized for low GWP refrigerants. Notably, in the case of flammable refrigerants, such as A2L and A3 refrigerants, there is a need to develop mitigation systems and methods that can detect the presence of leaked refrigerant and implement strategies for mitigating the leak. This disclosure addresses the aforementioned problems by providing an HVAC system that can detect the presence of a leak and discharge at least a portion or all of the refrigerant out from the HVAC system.

In one embodiment, the system comprises an evaporator coil configured to receive an airflow and to transfer heat from the received airflow to a flow of refrigerant. The system further comprises a compressor configured to receive the flow of refrigerant from the evaporator coil and to discharge the flow of refrigerant at a higher pressure. The system further comprises a refrigerant detection sensor disposed upstream of the evaporator coil and configured to detect a concentration of refrigerant in a volume. The system further comprises a controller operably coupled to the refrigerant detection sensor, comprising a memory and a processor. The memory is configured to store a threshold value associated with a lower flammability limit of the refrigerant, wherein the lower flammability limit corresponds to the concentration of the refrigerant. The processor is operably coupled to the memory and configured to operate the HVAC system in a first mode of operation, wherein the HVAC system is turned on and energized during the first mode of operation. The processor is further configured to receive a plurality of concentration measurements from the refrigerant detection sensor. The processor is further configured to determine if the concentration of refrigerant in the volume exceeds the stored threshold value based at least in part on the received plurality of concentration measurements. In response to determining that the concentration of refrigerant in the volume does exceed the stored threshold value, the processor is configured to operate the HVAC system in a second mode of operation. During the second mode of operation, the compressor is turned off and a blower disposed downstream of the evaporator coil is actuated to discharge the airflow.

Certain embodiments of the present disclosure may include some, all, or none of these advantages. These advantages and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

System Overview

Cooling systems cycle refrigerant to cool various spaces. For example, a heating, ventilation, and air conditioning (HVAC) system cycles refrigerant to cool spaces near or around air conditioner loads. Refrigerant may leak from the working-fluid conduit subsystem or from one or more components at certain locations throughout the HVAC system. Depending on the refrigerant used, there is a risk that the concentration of leaked refrigerant accumulates to a threshold value indicative of flammability.

This disclosure contemplates an unconventional cooling system capable of detecting leaked refrigerant and discharging the refrigerant out of the HVAC system to reduce the accumulated concentration. This disclosure contemplates using a refrigerant detection sensor disposed within a housing near the drain pan underneath the evaporator coils. The cooling system will be described using FIGS. 1 through 5, wherein FIG. 1 will describe the overall, improved cooling system, and FIGS. 2-5 will describe the configuration and operation of the refrigerant detection sensor within the cooling system in further detail.

Figure 1:
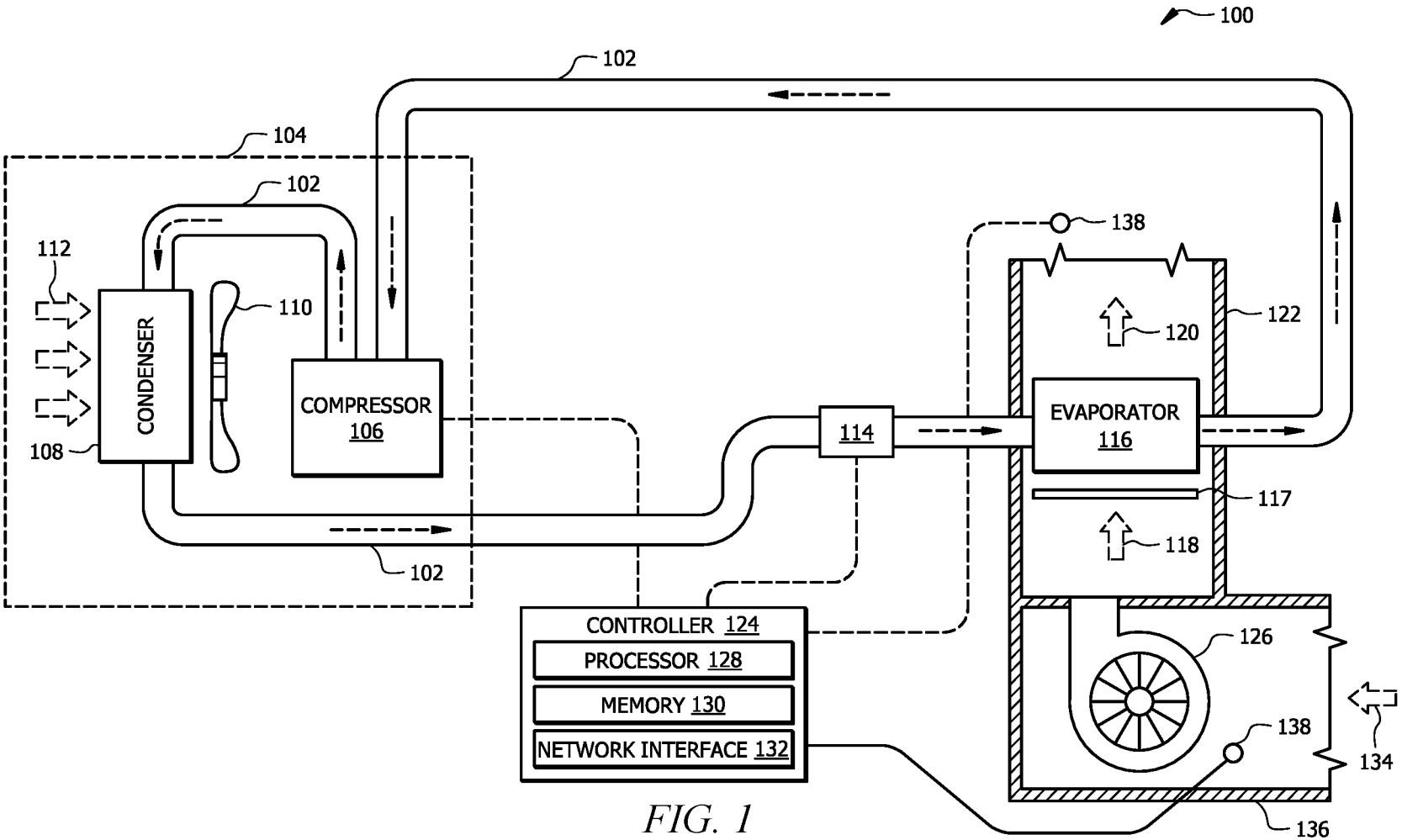
FIG. 1 is a schematic diagram of a HVAC system.

FIG. 1 is a schematic diagram of an embodiment of a HVAC system 100 configured to detect a concentration of refrigerant leaking from a conduit subsystem during operations. The HVAC system 100 is generally configured to perform cooling and/or heat pump cycles. The HVAC system 100 conditions air for delivery to an interior space of a building or home. The HVAC system 100 is generally configured to control the temperature of a space. Examples of a suitable space may include, but are not limited to, a room, a home, an apartment, a mall, an office, a warehouse, or a building. In embodiments, the HVAC system 100 may be a rooftop unit (RTU) that is positioned on the roof of a building and the conditioned air is delivered to the interior of the building. In other embodiments, portions of the system may be located within the building and a portion outside the building. The HVAC system 100 may also include heating elements that are not shown here for convenience and clarity. The HVAC system 100 may be configured as shown in FIG. 1 or in any other suitable configuration. For example, the HVAC system 100 may include additional components or may omit one or more components shown in FIG. 1. The HVAC system 100 may comprise a controller or thermostat, compressors, blowers, evaporators, condensers, and/or any other suitable type of hardware for controlling the temperature of the space. Although FIG. 1 illustrates a single HVAC system 100, a location or space may comprise a plurality of HVAC systems 100 that are configured to work together. For example, a large building may comprise multiple HVAC systems 100 that work cooperatively to control the temperature within the building.

The HVAC system 100 may comprise a working-fluid conduit subsystem 102 for moving a working fluid, or refrigerant, through a cooling cycle. The working fluid may be any acceptable working fluid, or refrigerant, including, but not limited to, fluorocarbons (e.g. chlorofluorocarbons), ammonia, non-halogenated hydrocarbons (e.g. propane), hydrofluorocarbons (e.g. R-410A), A2L refrigerants, or any other suitable type of refrigerant. Without limitations, A2L refrigerants may include R-454b, R-32, R-1234yf, and R-1234ze.

The HVAC system 100 may comprise one or more condensing units 104. In one embodiment, the condensing unit 104 comprises a compressor 106, a condenser coil 108, and a fan 110. The compressor 106 is coupled to the working-fluid conduit subsystem 102 that compresses the working fluid. The condensing unit 104 may be configured with a single-stage or multi-stage compressor 106 or with multiple compressors. In the configuration of one or more compressors, the one or more compressors can be turned on or off to adjust the cooling capacity of the HVAC system 100. In some embodiments, a compressor 106 may be configured to operate at multiple speeds or as a variable speed compressor. For example, the compressor 106 may be configured to operate at multiple predetermined speeds.

The condenser 108 is configured to assist with moving the working fluid through the working-fluid conduit subsystem 102. The condenser 108 is located downstream of the compressor 106 for rejecting heat. The fan 110 is configured to move air 112 across the condenser 108. For example, the fan 110 may be configured to blow outside air through the heat exchanger to help cool the working fluid. The fan 110 may be coupled to a motor, wherein the motor may be configured to actuate the fan 110.

With reference back to the flow of the working fluid, the compressed, cooled working fluid flows downstream from the condenser 108 to an expansion device 114, or a metering device. The expansion device 114 is configured to remove pressure from the working fluid. The expansion device 114 is coupled to the working-fluid conduit subsystem 102 downstream of the condenser 108 for removing pressure from the working fluid prior to flowing to an evaporator 116. The expansion device 114 may be closely associated with the evaporator 116. In this way, the working fluid is delivered to the evaporator 116 and receives heat from airflow 118 to produce a treated airflow 120 that is delivered by a duct subsystem 122 to the desired space, for example, a room in the building.

In embodiments, refrigerant, such as an A2L refrigerant, flowing through the working-fluid conduit subsystem 102 may have an increased probability of leaking in an area proximate to the evaporator 116. To maintain compliance standards, the HVAC system 100 may be configured to detect a concentration of leaking refrigerant and reduce the concentration within pre-determined periods of time. As illustrated, the HVAC system 100 may further comprise a refrigerant detection sensor 117 disposed in proximity to the evaporator 116 configured to detect a concentration of refrigerant in a volume. The refrigerant detection sensor 117 may be disposed upstream or downstream of the evaporator 116. The refrigerant detection sensor 117 may be any suitable sensor and/or collection of equipment operable to detect a concentration of refrigerant. Without limitations, the refrigerant detection sensor 117 may be a gas sensor, speed of sound sensor, thermal conductivity sensor, heated diode leak detector, or any combination thereof.

In an embodiment, the refrigerant detection sensor 117 may be in signal communication with a controller 124 using a wired or wireless connection. The controller 124 may be configured to provide commands or signals to control the operation of the HVAC system 100. An example of the controller 124 in operation is described further below in FIG. 5. For example, the controller 124 is configured to send signals to turn on or off a blower 126 to facilitate airflow over the evaporator 116, wherein the blower 126 may be disposed upstream or downstream of the evaporator 116. In another example, the controller 124 may be configured to receive a plurality of concentration measurements from the refrigerant detection sensor 117. In this example, the controller 124 may transmit instructions to the blower 126 based on a determination that the the concentration of refrigerant in the HVAC system 100 exceeds a stored threshold value.

As an example, the controller 124 may comprise a processor 128, a memory 130, and a network interface 132. In embodiments, the controller 124 may further comprise a graphical user interface, a display, a touch screen, buttons, knobs, or any other suitable combination of components. The controller 124 may be configured as shown or in any other suitable configuration.

The processor 128 comprises one or more processors operably coupled to the memory 130. The processor 128 is any electronic circuitry including, but not limited to, state machines, one or more central processing unit (CPU) chips, logic units, cores (e.g. a multi-core processor), field-programmable gate array (FPGAs), application-specific integrated circuits (ASICs), or digital signal processors (DSPs). The processor 128 may be a programmable logic device, a microcontroller, a microprocessor, or any suitable combination of the preceding. The processor 128 is communicatively coupled to and in signal communication with the memory 130 and the network interface 132. The one or more processors may be configured to process data and may be implemented in hardware or software. For example, the processor 128 may be 8-bit, 16-bit, 32-bit, 64-bit, or of any other suitable architecture. The processor 128 may include an arithmetic logic unit (ALU) for performing arithmetic and logic operations, processor registers that supply operands to the ALU and store the results of ALU operations, and a control unit that fetches instructions from memory and executes them by directing the coordinated operations of the ALU, registers and other components. The one or more processors are configured to implement and execute various instructions. The instructions may comprise any suitable set of instructions, logic, rules, or code operable to be executed. In this way, processor 128 may be a special-purpose computer designed to implement the functions disclosed herein.

Figure 5:
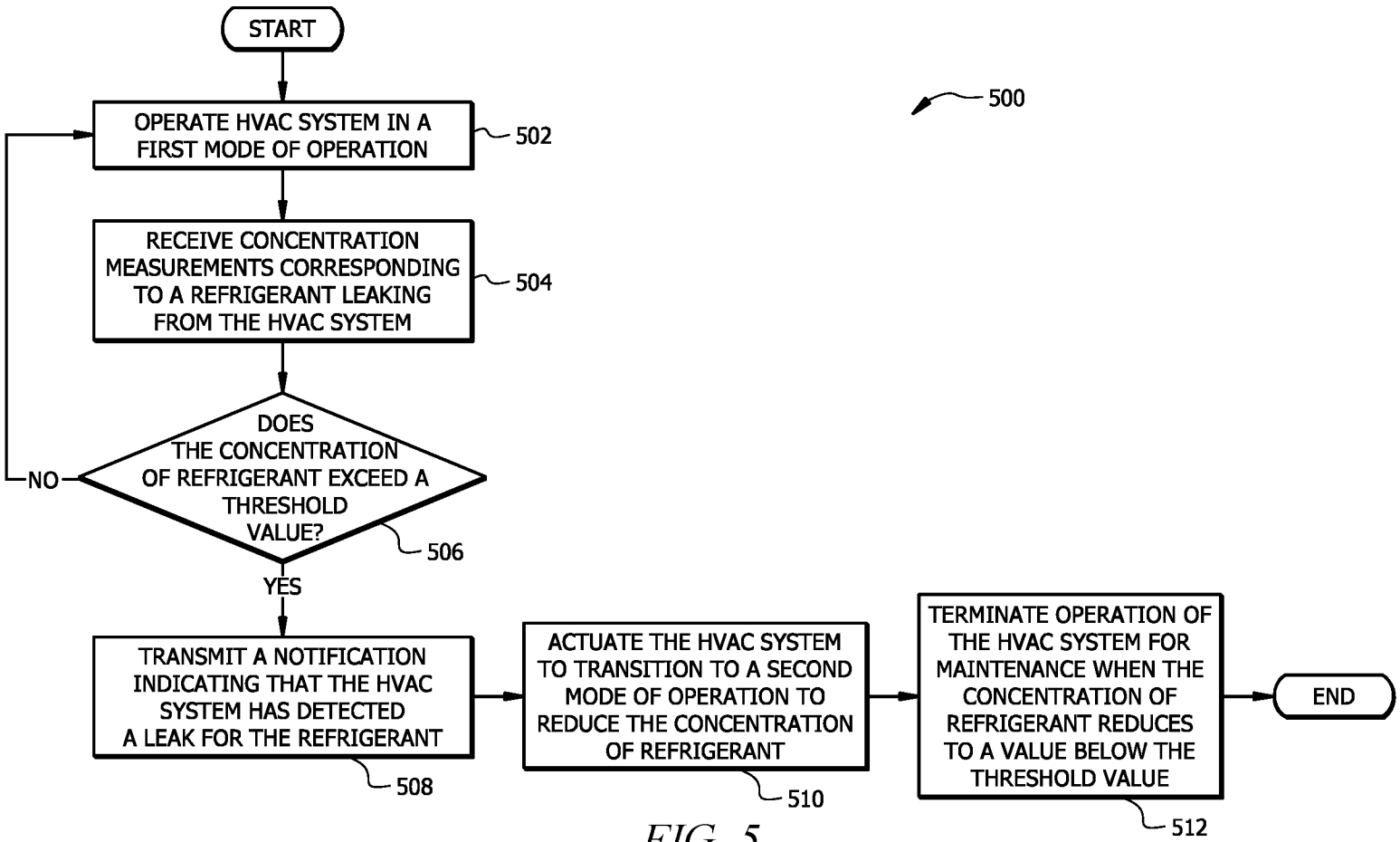
FIG. 5 is a flowchart of an example process for the HVAC system of FIG. 1.

The memory 130 is operable to store any of the information described with respect to FIGS. 1 and 5 along with any other data, instructions, logic, rules, or code operable to implement the function(s) described herein when executed by the processor 128. The memory 130 comprises one or more disks, tape drives, or solid-state drives, and may be used as an over-flow data storage device, to store programs when such programs are selected for execution, and to store instructions and data that are read during program execution. The memory 130 may be volatile or non-volatile and may comprise a read-only memory (ROM), random-access memory (RAM), ternary content-addressable memory (TCAM), dynamic random-access memory (DRAM), and static random-access memory (SRAM).

The network interface 132 is configured to enable wired and/or wireless communications. The network interface 132 is configured to communicate data between the controller 124 and other devices (e.g. sensors and the HVAC system 100), systems, or domains. For example, the network interface 132 may comprise an NFC interface, a Bluetooth interface, a Zigbee interface, a Z-wave interface, an RFID interface, a WIFI interface, a LAN interface, a WAN interface, a PAN interface, a modem, a switch, or a router. The processor 128 may be configured to send and receive data using the network interface 132. The network interface 132 may be configured to use any suitable type of communication protocol as would be appreciated by one of ordinary skill in the art.

In further embodiments, controller 124 may include a display that is a graphical user interface configured to present visual information to a user using graphical objects. Examples of a display include, but are not limited to, a liquid crystal display (LCD), a liquid crystal on silicon (LCOS) display, a light-emitting diode (LED) display, an active-matrix OLED (AMOLED), an organic LED (OLED) display, a projector display, or any other suitable type of display as would be appreciated by one of ordinary skill in the art.

A portion of the HVAC system 100 may be configured to move air across the evaporator 116 and out of the duct sub-system 122. Return air 134, which may be air returning from the building, fresh air from outside, or some combination, is pulled into a return duct 136. A variable-speed blower, such as blower 126, may pull the return air 134 into the return duct 136 where the airflow 118 crosses the evaporator 116 or heating elements (not shown) to produce the treated airflow 120. In these embodiments, the return air 134 may be the same airflow as airflow 118 or may be discharged as airflow 118 by blower 126.

The HVAC system 100 may comprise one or more sensors 138 in signal communication with the controller 124. The sensors 138 may comprise any suitable type of sensor for measuring the air temperature. The sensors 138 may be positioned anywhere within a conditioned space (e.g. a room or building) and/or the HVAC system 100. For example, the HVAC system 100 may comprise a sensor 138 positioned and configured to measure an outdoor air temperature. As another example, the HVAC system 100 may comprise a sensor 138 positioned and configured to measure a supply or treated air temperature and/or a return air temperature. In other examples, the HVAC system 100 may comprise sensors 138 positioned and configured to measure any other suitable type of air temperature, pressure, humidity, or any other suitable parameter.

The HVAC system 100 may comprise one or more thermostats, for example, located within a conditioned space (e.g. a room or building). The thermostat may be a single-stage thermostat, a multi-stage thermostat, or any suitable type of thermostat as would be appreciated by one of ordinary skill in the art. The thermostat may be configured to allow a user to input a desired temperature or temperature set point for a designated space or zone such as the room.

Example HVAC System as a Rooftop Unit (RTU)

Figure 2:
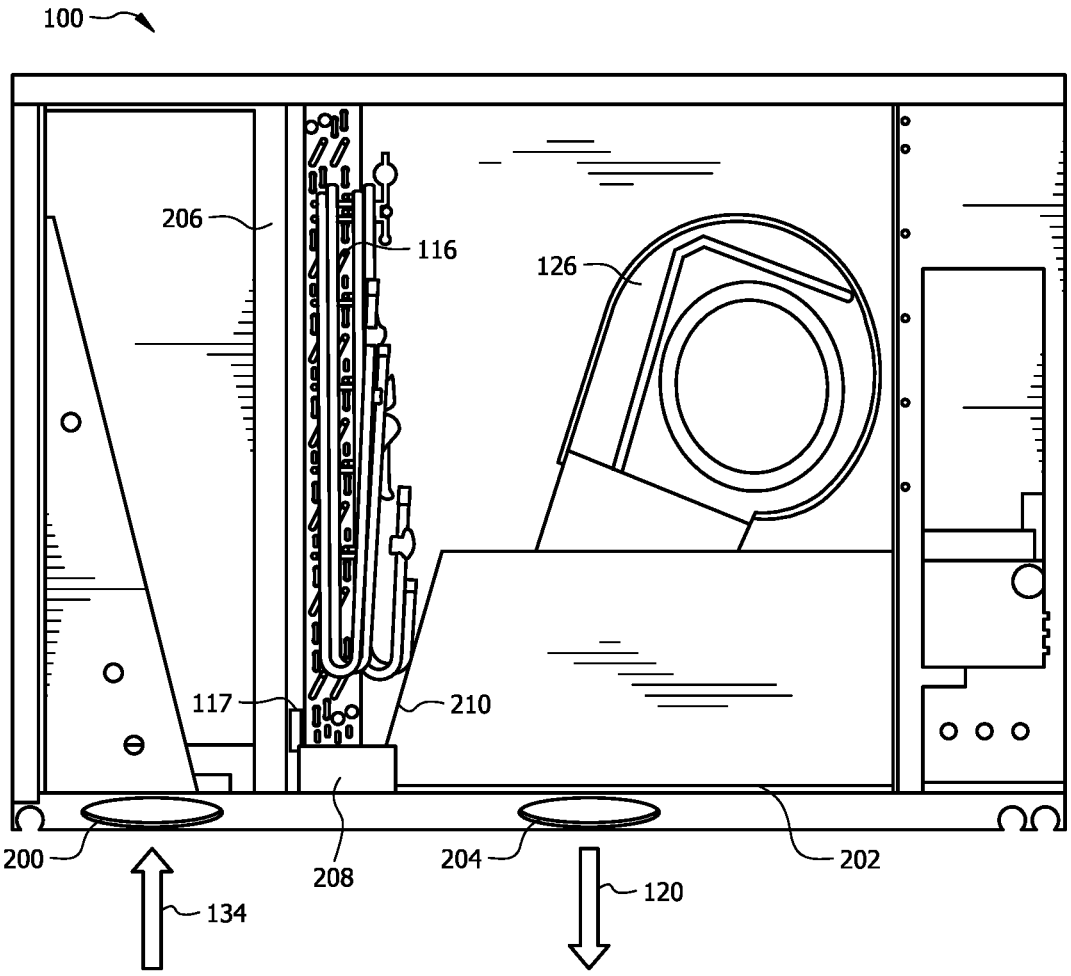
FIG. 2 is a cross-sectional side-view of the HVAC system of FIG. 1.

FIG. 2 is a cross-sectional side-view of the HVAC system 100 as an RTU. In embodiments, the HVAC system 100 may be positioned on the roof of a building and the conditioned air, such as treated airflow 120, is delivered to the interior of the building. In other embodiments, portions of the HVAC system 100 may be located within the building and a portion outside the building. As illustrated, return air 134 may be received by the HVAC system 100 for treatment and enter the RTU through an inlet 200 fluidly coupled to return duct 136 (reference to FIG. 1). The blower 126 may be actuated to pull in the return air 134 into and through the RTU. As illustrated, the blower 126 may be disposed downstream of the evaporator 116 and on top of a blower stand 202. The blower stand 202 may comprise any suitable size, height, shape, and any combinations thereof. Further, the blower stand 202 may comprise any suitable materials, such as metals, nonmetals, polymers, composites, and any combinations thereof. The blower stand 202 may be at least partially hollow, wherein the blower 126 may discharge the return air 134 as treated airflow 120 through the blower stand 126 and out of the RTU via an outlet 204.

The return air 134 may engage with the evaporator 116 as the return air 134 flows through the RTU. For example, during a refrigeration cycle, heat may transfer from the return air 134 to the refrigerant flowing through the evaporator 116 as the return air 134 flows through and/or around evaporator 116. The removal of heat from return air 134 may reduce the temperature of the return air 134, thereby treating the return air 134 and producing treated airflow 120. Before flowing through the evaporator 116, the return air 134 may engage with an air filter 206 disposed upstream of the evaporator 116. The air filter 206 may be any suitable filter configured to remove at least a portion of particles or particulate matter present within an airflow. The air filter 206 may be configured to remove particles from the return air 134 prior to the HVAC system 100 discharging the return air 134 after treatment (i.e., as treated airflow 120).

The HVAC system 100 may further comprise a drain pan 208 disposed underneath the evaporator 116. The drain pan 208 may be configured to collect condensation or any fluids that may be produced and find their way to the drain pan.

For example, operation of evaporator 116 may produce water condensate from return air 134 as heat is removed from the return air 134. In another example, ice and/or frost build-up present on the coils of the evaporator 116 may melt and produce water condensate during a defrost cycle. The drain pan 208 may comprise any suitable size, height, shape, and any combinations thereof. Further, the drain pan 208 may comprise any suitable materials, such as metals, nonmetals, polymers, composites, and any combinations thereof. The drain pan 208 may be flat and/or angled to help direct liquids to a drain aperture, or drain, and an associated drain line to discharge the collected condensate out of the RTU. As illustrated, the drain pan 208 may be disposed under the evaporator 116 and between the air filter 206 and the blower stand 206.

The blower stand 206 may comprise at least one side 210 that is angled with respect to a vertical axis, wherein the angle of the at least one side 210 provides for the blower stand 206 to direct a fluid down and towards the drain pan 208. For example, if refrigerant is leaking from evaporator 116 during operations, gravity may pull the refrigerant in a downward direction toward the drain pan 208 as the refrigerant may weigh more than the surrounding air. However, air may be flowing through the RTU and may force the falling refrigerant in a lateral direction vertically offset from the drain pan 208. In this example, the refrigerant may encounter the at least one side 210 of the blower stand 206 and may be directed to flow back towards the drain pan 208.

Figure 3A:
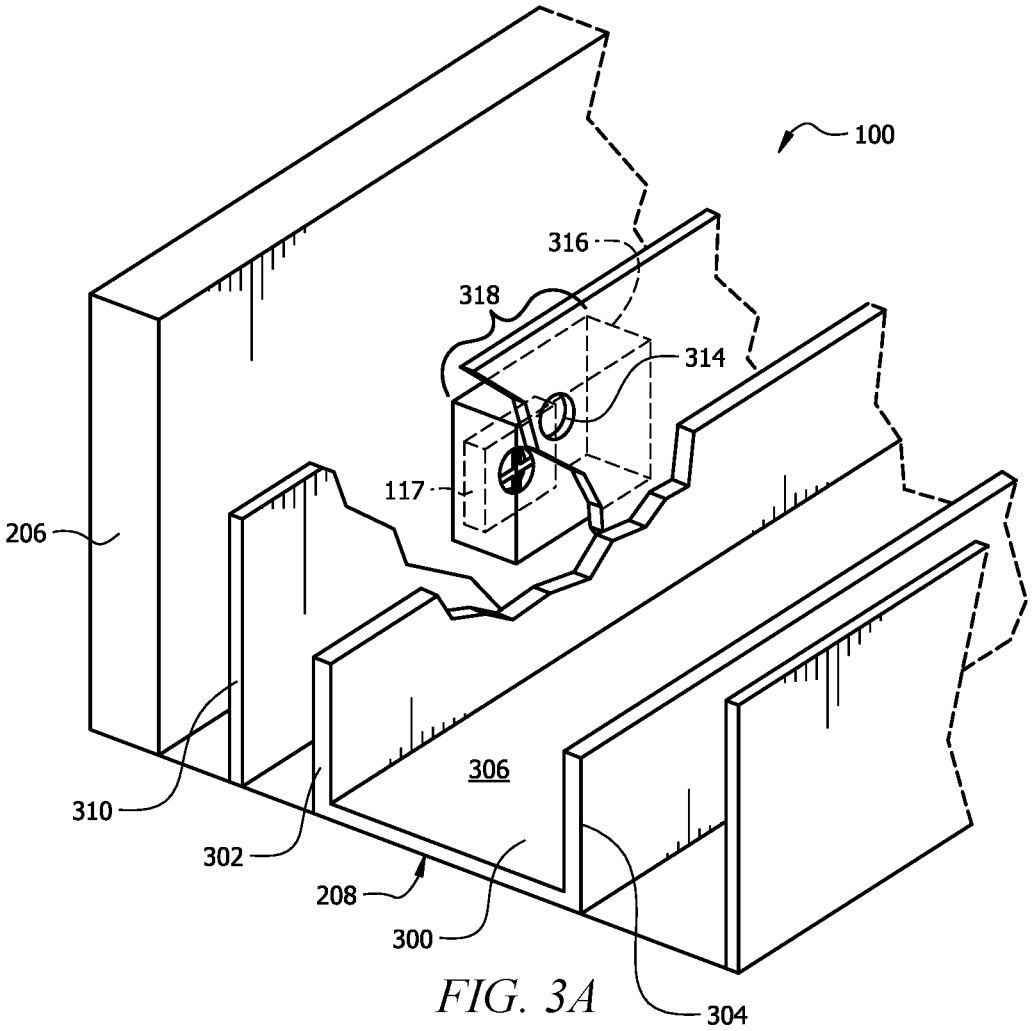
FIG. 3A is an isometric cross-sectional embodiment of a portion of the HVAC system of FIG. 1.
Figure 3B:
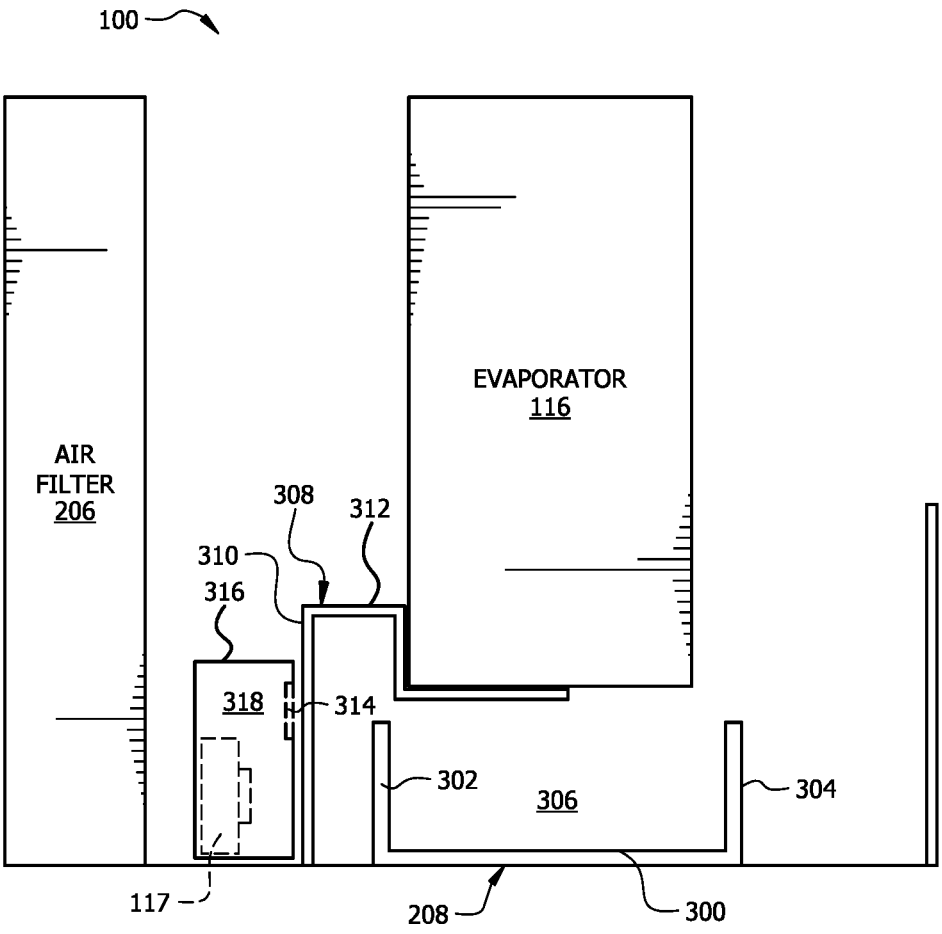
FIG. 3B is a cross-sectional side-view embodiment of a portion of the HVAC system of FIG. 1.

FIGS. 3A and 3B each illustrate cross-sectional embodiments of a portion of the HVAC system 100. As illustrated, the evaporator 116 may be disposed above the drain pan 208, wherein the drain pan 208 may be configured to collect condensate and any other suitable fluid (for example, refrigerant leaking from evaporator 116). The drain pan 208 may comprise a base 300, a first side 302, and a second side 304. The base 300 may be disposed along the bottom of the HVAC system 100, wherein both the first side 302 and the second side 304 may extend vertically upward and away from the base 300. The first side 302 may be disposed at one side of the base 300, and the second side 304 may be disposed at another side of the base 300 opposite from the first side 302. Both the first side 302 and the second side 304 may comprise the same dimensions, such as having an equivalent height. In other embodiments, first side 302 may have a height less than the height of second side 304. As illustrated, the base 300, first side 302, and second side 304 may define a channel 306, wherein any suitable condensate or fluids may flow into and be partially contained by the channel 300. The drain pan 208 may have an open side, opposite from the base 300, wherein condensate or fluids may flow into and be received by the channel 306. In certain embodiments, there may be a drain (not shown) disposed at a suitable location along the base 300 where condensate or fluids contained within the channel 306 may be directed for discharge.

The HVAC system 100 may comprise a flange 308 disposed adjacent to the drain pan 208 and at the bottom of the HVAC system 100. The flange 308 may be configured to section off a portion of HVAC system 100 and prevent condensate or fluids overflowing from the drain pan 208 to spread upstream from the evaporator 116.

The flange 308 may be disposed between the air filter 206 and the drain pan 208. In embodiments, the flange 308 may have approximately an equivalent length as the RTU (i.e., the HVAC system 100). The flange 308 may have a length equal to or greater than the drain pan 208. The flange 308 may comprise any suitable size, height, shape, and any combinations thereof. Further, the flange 308 may comprise any suitable materials, such as metals, nonmetals, polymers, composites, and any combinations thereof. The flange 308 may comprise a main support 310 and a lateral side 312. The main support 310 may extend vertically upwards from the bottom of the HVAC system 100. The lateral side 312 may be disposed perpendicular to the main support 310 and may extend towards the drain pan 208. The lateral side 312 may extend to an area at least partially below the evaporator 116. As illustrated, the lateral side 312 may be disposed at a height greater than the first side 302 of drain pan 208, wherein there may be a clearance of any suitable distance between the lateral side 312 and first side 302.

There may be a hole 314 defined in the main support 310. The hole 314 may be any suitable size and shape. The hole 314 may be disposed at a height greater than the first side 302 of the drain pan 208. In other embodiments, hole 314 may be disposed at a height less than the first side 302. The hole 314 may be configured to direct refrigerant having leaked from HVAC system 100 into a housing 316 containing the refrigerant detection sensor 117. The housing 316 may comprise any suitable size, height, shape, and any combinations thereof. As shown, the housing 316 may generally be rectangular, but the housing 316 is not limited to such a shape. Further, the housing 316 may comprise any suitable materials, such as metals, nonmetals, polymers, composites, and any combinations thereof. The housing 316 may be defined by a plurality of closed sides disposed against the main support 310 of the flange 308. In embodiments, the housing 316 may be sealed against the main support 310. The housing 316 may define an internal volume 318 used for detecting a concentration of refrigerant by the refrigerant detection sensor 117. The housing 316 may be disposed between the flange 308 and the air filter 206. In embodiments, the housing 316 may be disposed in proximity to an internal access point for the HVAC system 100 (for example, within 30 inches from an access door to an RTU) for ease of maintenance and field servicing.

The housing 316 may be configured to contain the refrigerant detection sensor 117 within the internal volume 318. The housing 316 may be configured to prevent leaked refrigerant from diffusing away from the internal volume 318 and protect the refrigerant detection sensor 117 from an external environment. The refrigerant detection sensor 117 may be disposed at a bottom of the housing 316. In other embodiments, the refrigerant detection sensor 117 may be elevated within the housing 316 as long as the hole 314 maintains a greater height (i.e., the refrigerant detection sensor 117 is not disposed along a parallel plane in-line with the hole 314). In these embodiments, the height difference may prevent fluid from splashing against the refrigerant detection sensor 117 as fluid enters the housing 316 through the hole 314.

During operation of HVAC system 100, refrigerant may leak and be collected in drain pan 208. In embodiments, the collected refrigerant may start to overflow and spill over first side 302 between the first side 302 and the main support 310 of flange 308. The refrigerant may then encounter hole 314 and flow into the housing 316 via the hole 314. As the refrigerant flows into the housing 316, the refrigerant may be contained in the housing 316, and the refrigerant detection sensor 117 may measure a concentration of that refrigerant with respect to the internal volume 318 over a period of time. The refrigerant detection sensor 117 may be configured to transmit a plurality of concentration measurements of the refrigerant to the controller 124 (referring to FIG. 1) for further operations.

Figure 4:
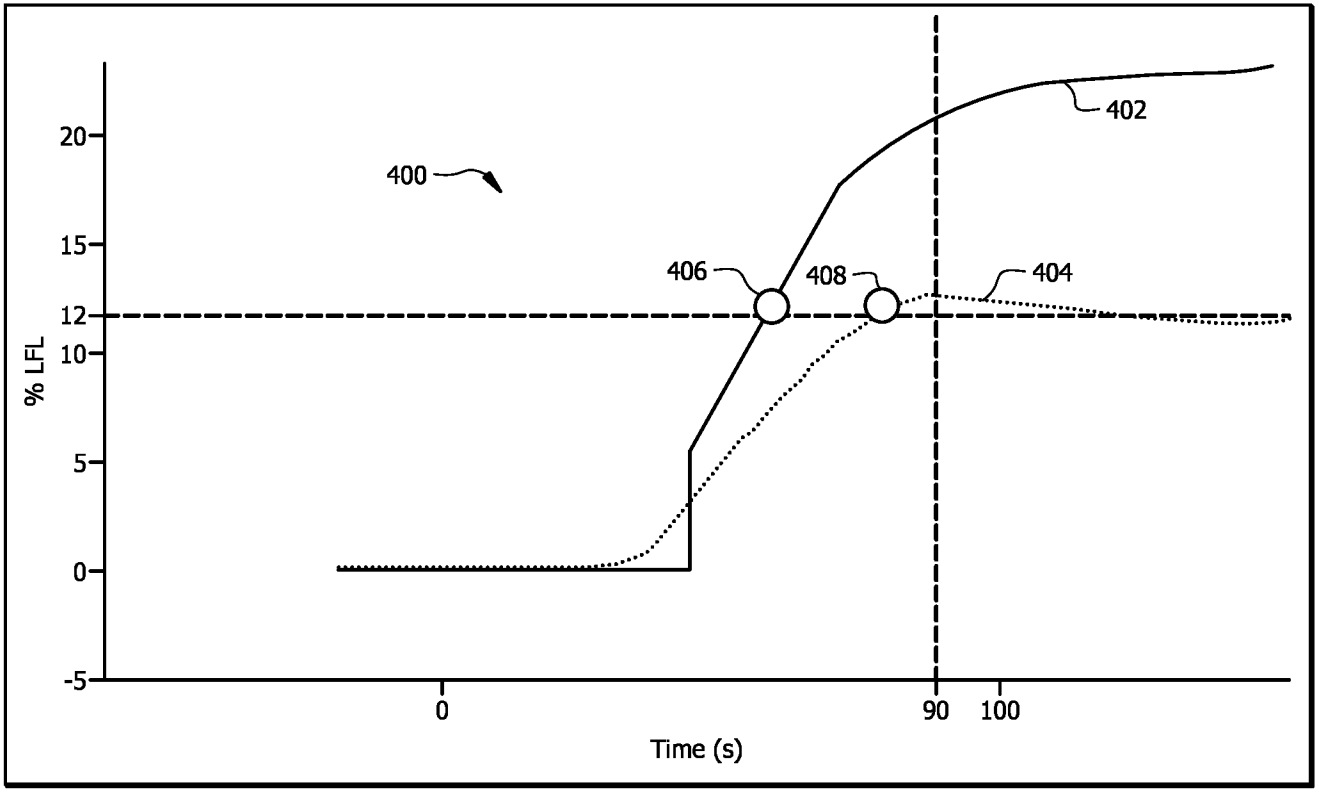
FIG. 4 is graph comparing performance of a refrigerant detection sensor within a housing against the refrigerant detection sensor without the housing.

FIG. 4 illustrates a graph 400 comparing performance of the refrigerant detection sensor 117 (referring to FIG. 1) within the housing 316 (referring to FIGS. 3A-3B) against the refrigerant detection sensor 117 without the housing 316. In embodiments, the refrigerant may be classified as an A2L refrigerant. Certain properties of A2L refrigerants, such as flammability, may be related to how concentrated a given refrigerant is within a volume. To meet compliance standards, the HVAC system 100 may be configured to determine when a lower flammability limit (LFL) of a refrigerant exceeds a threshold value within a specified period of time. The HVAC system 100 may further be configured to reduce the LFL of the refrigerant if there is a determination that the LFL exceeds the threshold value within a second period of time.

Graph 400 depicts a first line 402 illustrating performance of refrigerant detection sensor 117 with the housing 316 and a second line 404 illustrating performance of refrigerant sensor 117 without the housing 316. In these embodiments, performance is measured as % LFL over time. As illustrated at a first point 406, the HVAC system 100 was able to determine that the % LFL of refrigerant present within the internal volume 318 (referring to FIGS. 3A-3B) of housing 316 was 12% at 60 seconds based on measurements received by the refrigerant detection sensor 117 within the housing 316. At a second point 408, the graph 400 illustrates the HVAC system 100 determining that the % LFL of refrigerant present within a volume defined by the RTU was 12% at 82 seconds, wherein the refrigerant detection sensor 117 was not within the housing 316 and open to the interior of the RTU. In these embodiments, the relevant compliance standards may have required detection of a refrigerant at 12% LFL to occur within 90 seconds. Graph 400 illustrates both first line 402 and second line 404 satisfying this standard, but first line 402 shows that having the refrigerant detection sensor 117 within the housing 316 having an internal volume 318 is faster and more efficient than not having the refrigerant detection sensor 117 disposed within the housing 316.

Example Operation of the HVAC System

FIG. 5 is a flowchart of an embodiment of a process 500 for the HVAC system 100. The HVAC system 100 may employ process 500 for operating refrigerant detection sensor 117 (referring to FIG. 1) and the HVAC system 100. At operation 502, processor 128 (referring to FIG. 1) of the controller 124 (referring to FIG. 1) may operate the HVAC system 100 in a first mode of operation. For example, the first mode of operation may be an energized status after being turned on for a refrigeration cycle or a heat pump cycle. In an example, the HVAC system 100 may be energized to idle in anticipation of a demand. The processor 128 may then transmit instructions to turn on the blower 126 (referring to FIG. 1), the compressor 106 (referring to FIG. 1), the fan 110 (referring to FIG. 1), and any combination thereof for either the refrigeration cycle or heat pump cycle. Operation of the aforementioned components may enable heat transfer between the refrigerant flowing within the working-fluid conduit subsystem 102 (referring to FIG. 1) and either the condenser 108 (referring to FIG. 1) or the evaporator 116 (referring to FIG. 1).

At operation 504, the processor 128 of the controller 124 may receive a plurality of concentration measurements of a refrigerant leaking from the working-fluid conduit subsystem 102. For example, during operation of HVAC system 100 in a first mode o operation, refrigerant may leak and be collected in the drain pan 208 (referring to FIG. 2). The collected refrigerant may overflow and spill over the first side 302 (referring to FIGS. 3A-3B) of drain pan 208 between the first side 302 and the main support 310 (referring to FIGS. 3A-3B) of the flange 308 (referring to FIGS. 3A-3B). The refrigerant may then encounter hole 314 (referring to FIGS. 3A-3B) and flow into the housing 316 (referring to FIGS. 3A-3B) via the hole 314. As the refrigerant flows into the housing 316, the refrigerant detection sensor 117 may measure a concentration of that refrigerant with respect to the internal volume 318 (referring to FIGS. 3A-3B) of the housing 316 over a period of time. The refrigerant detection sensor 117 may transmit the plurality of concentration measurements to the controller 124.

At operation 506, the processor 128 of the controller 124 may determine whether or not the concentration of refrigerant in the internal volume 318 exceeds a threshold value. For example, the memory 130 (referring to FIG. 1) may store the threshold value for a refrigerant associated with a lower flammability limit (LFL), wherein the LFL corresponds to the concentration of the refrigerant. In embodiments, the LFL may refer to the lowest concentration of a substance in the air capable of igniting in the presence of an ignition source. If the processor 128 determines that the concentration of refrigerant in the internal volume 318 does not exceed the stored threshold value, the process 500 proceeds back to operation 502. Otherwise, the process 500 proceeds to operation 508.

At operation 508, the processor 128 of the controller 124 may transmit a notification indicating that the HVAC system 100 has detected a leak of refrigerant. Transmission of the notification may occur in conjunction with, before, or after the HVAC system 100 transitions from the first mode of operation to a second mode of operation to reduce the concentration of refrigerant leaking into the HVAC system 100.

At operation 510, the processor 128 of the controller 124 may actuate the HVAC system 100 to transition to the second mode of operation. During the second mode of operation, the processor 128 may transmit an instruction to turn off the compressor 106 and to actuate the blower 126 to discharge an airflow. In these embodiments, the airflow may comprise a concentration of refrigerant exceeding the stored threshold value. Discharging the airflow may reduce the concentration of refrigerant present within the HVAC system 100.

At operation 512, the processor 128 of the controller 124 may terminate operation of the HVAC system 100 for maintenance when the concentration of refrigerant decreases to a value below the stored threshold value in the memory 130 as a result, for example, of discharging the airflow in conjunction with operation 510. For example, after the HVAC system 100 transitions to the second mode of operation, the concentration of refrigerant leaking within the HVAC system 100 decreases due to the discharge of the leaked refrigerant mixed with the air. There may be a certain volume of leaked refrigerant remaining within one or more components in the HVAC system 100, such as in the drain pan 208 and/or housing 316. The HVAC system 100 may terminate operations in order for an operator to access and service the interior of the HVAC system 100, wherein the process 500 may then proceed to end.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated with another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

The invention claimed is:

1. A heating, ventilation, and air conditioning (HVAC) system, comprising:

an evaporator coil configured to receive an airflow and to transfer heat from the received airflow to a flow of refrigerant;

a drain pan disposed underneath the evaporator coil, wherein the drain pan comprises a base, a first side extending vertically from the base, and a second side extending vertically from the base;

a main support disposed between the drain pain and an air filter, wherein the main support extends vertically to define a space between the main support and the first side of the drain pan, wherein the main support includes a hole;

a housing disposed against the main support such that any leaked refrigerant that overflows the first side of the drain pan and that accumulates in the space, flows into the housing through the hole;

a compressor configured to receive the flow of refrigerant from the evaporator coil and to discharge the flow of refrigerant at a higher pressure;

a refrigerant detection sensor disposed within the housing and configured to detect a concentration of refrigerant in a volume defined by the housing; and a controller operably coupled to the refrigerant detection sensor, comprising:

a memory configured to store a threshold value associated with a lower flammability limit of the refrigerant, wherein the lower flammability limit corresponds to the concentration of the refrigerant; and a processor operably coupled to the memory, configured to:

operate the HVAC system in a first mode of operation, wherein the HVAC system is turned on and energized during the first mode of operation;

receive a plurality of concentration measurements from the refrigerant detection sensor;

determine if the concentration of refrigerant in the volume exceeds the stored threshold value based at least in part on the received plurality of concentration measurements; and in response to determining that the concentration of refrigerant in the volume does exceed the stored threshold value, operate the HVAC system in a second mode of operation;

wherein during the second mode of operation:

the compressor is turned off; and a blower disposed proximate to the evaporator coil is actuated to discharge the airflow.

2. HVAC system of claim 1, wherein the housing is disposed between the evaporator coil and an air filter.

3. The HVAC system of claim 2, wherein the hole is vertically offset from the refrigerant detection sensor.

4. The HVAC system of claim 3, further comprising a blower stand disposed adjacent to the drain pan opposite from the housing, wherein the blower is disposed on top of the blower stand.

5. The HVAC system of claim 1, wherein the refrigerant is classified as an A2L refrigerant.

6. The HVAC system of claim 1, wherein the processor is further configured to:

transmit a notification indicating that the HVAC system has detected a leak for the refrigerant in conjunction with the HVAC system transitioning from the first mode of operation to the second mode of operation.

7. The HVAC system of claim 1, further comprising a condensing unit configured to reject heat from the flow of refrigerant, wherein the condensing unit comprises a condenser and at least one fan.

8. A method of operating a heating, ventilation, and air conditioning (HVAC) system, comprising:

operating the HVAC system in a first mode of operation, wherein the HVAC system is turned on and energized during the first mode of operation;

receiving a plurality of concentration measurements from a refrigerant detection sensor disposed upstream of the evaporator coil;

determining if a concentration of a refrigerant in a volume exceeds a stored threshold value based at least in part on the received plurality of concentration measurements;

in response to determining that the concentration of refrigerant in the volume does exceed the stored threshold value, actuating the HVAC system to operate in a second mode of operation; and terminating operation of the HVAC system for maintenance when the concentration of refrigerant reduces to a value below the stored threshold value.

9. The method of claim 8, wherein the refrigerant detection sensor is disposed within a housing defining the volume, wherein the housing is disposed between the evaporator coil and an air filter.

10. The method of claim 9, wherein there is a hole defined in the housing that is vertically offset from the refrigerant detection sensor, wherein the hole is disposed at a height greater than a drain pan disposed underneath the evaporator coil.

11. The method of claim 10, wherein the HVAC system further comprises a blower stand disposed adjacent to the drain pan opposite from the housing, wherein a blower is disposed on top of the blower stand.

12. The method of claim 8, further comprising transmitting a notification indicating that the HVAC system has detected a leak for the refrigerant in conjunction with the HVAC system transitioning from the first mode of operation to the second mode of operation.

13. The method of claim 8, wherein the refrigerant is classified as an A2L refrigerant.

14. A non-transitory computer-readable medium comprising instructions that, when executed by a processor, cause the processor to:

operate a heating, ventilation, and air conditioning (HVAC) system in a first mode of operation, wherein the HVAC system is turned on and energized during the first mode of operation;

receive a plurality of concentration measurements from a refrigerant detection sensor disposed upstream of the evaporator coil;

determine if a concentration of a refrigerant in a volume exceeds a stored threshold value based at least in part on the received plurality of concentration measurements;

in response to determining that the concentration of refrigerant in the volume does exceed the stored threshold value, operate the HVAC system in a second mode of operation;

wherein during the second mode of operation:

the compressor is turned off; and a blower disposed proximate to the evaporator coil is actuated to discharge an airflow; and terminate operation of the HVAC system for maintenance when the concentration of refrigerant reduces to a value below the stored threshold value.

15. The non-transitory computer-readable medium of claim 14, wherein the refrigerant detection sensor is disposed within a housing defining the volume, wherein the housing is disposed between the evaporator coil and an air filter.

16. The non-transitory computer-readable medium of claim 15, wherein there is a hole defined in the housing that is vertically offset from the refrigerant detection sensor, wherein the hole is disposed at a height greater than a drain pan disposed underneath the evaporator coil.

17. The non-transitory computer-readable medium of claim 16, wherein the HVAC system further comprises a blower stand disposed adjacent to the drain pan opposite from the housing, wherein the blower is disposed on top of the blower stand.

18. The non-transitory computer-readable medium of claim 14, wherein the refrigerant is classified as an A2L refrigerant.

19. The non-transitory computer-readable medium of claim 14, wherein the instructions further cause the processor to:

transmit a notification indicating that the HVAC system has detected a leak for the refrigerant in conjunction with the HVAC system transitioning from the first mode of operation to the second mode of operation.

* * * * *